US005095885A

United States Patent [19]

Komatsuzaki

[11] Patent Number: 5,095,885

[45] Date of Patent: Mar. 17, 1992

[54] INSIDE GRINDSTONE AND WASHING METHOD THEREOF

[76] Inventor: Yasuo Komatsuzaki, No. 4-36, Yoshicho 1-chome, Soka-shi, Saitama, Japan

[21] Appl. No.: 538,819

[22] Filed: Jun. 15, 1990

[30] Foreign Application Priority Data

Aug. 14, 1989 [JP] Japan ..... 63-207840

[51] Int. Cl.[5] ..... B28D 1/04; B24B 7/00

[52] U.S. Cl. ..... 125/13.02; 125/15; 51/73 R; 51/295

[58] Field of Search ..... 125/13.01, 13.02, 15; 51/206 R, 206.4, 73 R, 295, 297

[56] References Cited

U.S. PATENT DOCUMENTS 3,491,742 1/1970 Weiss ..... 51/73
3,765,132 10/1973 Mackey et al. ..... 51/206 R
4,407,263 10/1983 Murata ..... 51/206 R
4,677,963 7/1987 Ajamian ..... 125/15

*Primary Examiner*—D. S. Meislin
*Attorney, Agent, or Firm*—Lowe, Price, LeBlanc & Becker

[57] ABSTRACT

In an inside grindstone and a washing method thereof, a plurality of concave cut-outs are arranged on both sides of a cutting-edge layer which is formed at an inner periphery of an annular substrate. Parts of abrasive grains at both sides of an outer periphery of the cutting-edge layer are smaller in projecting amount than parts of the abrasive grains on an inner periphery of the cutting-edge layer.

The washing method comprises the step of blowing off shavings accumulated in the concave cut-outs, by abrasive liquid and jetting gas which are jetted toward the cutting-edge layer.

9 Claims, 3 Drawing Sheets

INSIDE GRINDSTONE AND WASHING METHOD THEREOF

BACKGROUND OF THE INVENTION

The present invention relates to an inside grindstone having an annular substrate whose inner periphery is formed with a cutting-edge layer, and to a method of washing the inside grindstone.

In a wafer processing technique in which a semiconductor material in the form of an ingot is cut to form a plurality of wafers, it is an important matter to reduce a machining allowance at cutting and to secure parallelism and surface roughness. For this reason, cutting operation is done by an inside grindstone.

At present, the following inside grindstone is used for processing wafers. That is, the inside grindstone comprises an annular substrate which is made of stainless steel or the like and which has its thickness of 100 μm to 150 μm. The annular substrate has its inner periphery which is formed with a cutting-edge layer, using diamond abrasive grains, by means of a bond that is electrodeposition bond such as nickel or the like. The cutting-edge layer has its thickness of approximately 250 μm to 300 μm and its width of approximately 2 mm to 5 mm.

FIGS. 5 and 6 of the attached drawings show a construction of the conventional inside grindstone. The conventional inside grindstone 100 comprises an annular substrate 101 whose inner periphery is formed with a cutting-edge layer 102. In order to facilitate discharge of shavings generated at cutting operation and washing of the inside grindstone 100, the thickness of the cutting-edge layer 102 is so formed as to be gradually thinned from an inner periphery 102*a* of the cutting-edge layer 102 toward an outer periphery 102*b* thereof.

The inside grindstone 100 is mounted to a vertical cutter or the like at processing of the wafers, and the cutting operation is done while abrasive is blown against the cutting-edge layer 102. At this time, shavings, which are generated by cutting of a brittle semiconductor material (hereinafter referred to as "work") such as silicon or the like, are minute or fine particles in the form of acute angle, which have grain size equal to or less than 1 μm and which are difficult to flow. Further, the abrasive blown against the cutting-edge layer 102 is scattered toward the outer periphery of the annular substrate 101 by the inside grindstone 100 which is rotated at high speed. Accordingly, there are the following drawbacks or disadvantages. That is, it is impossible for the inside grindstone constructed as above to exhibit sufficient discharge and washing effects. Loading occurs at the cutting-edge layer 102, particularly, at the inner periphery 102*a* which exerts a great influence upon the cutting efficiency, so that the cutting performance is reduced. Moreover, since unreasonable stress acts upon the work, a layer of processing change in quality at the work surface increases in thickness.

When the loading occurs at the inner periphery 102*a* so that the cutting resistance increases, the cutting-edge layer 102 is swung or oscillated laterally so that the lateral side of the cutting-edge layer 102 is in contact with the work. Accordingly, the cut surface of the work is inadvertently shaved so that parallelism and surface roughness are damaged. Further, the annular substrate 101 per se is gradually deformed by an external force which acts upon the annular substrate 101 from the lateral side of the cutting-edge layer 102. Thus, the cutting-edge layer 102 is brought to such a state that the cutting-edge layer 102 further tends to be in contact with the cut surface of the work.

Deformation of the annular substrate 101, which is increased by the above-described vicious circle, increases the substantial thickness of the cutting-edge layer 102 so that the machining allowance of the work is made large. Thus, the parallelism and the surface roughness of the cut surface of the work are damaged. Further, the layer of processing change in quality also increases gradually so that the quality of the cut wafers is considerably reduced.

The drawbacks of the kind referred to above in the conventional technique become further intensified, accompanied with an increase in diameter of the work or ingot. In the present stage, the operator intends to cope with such drawbacks by a method or the like in which the deformation of the annular substrate 101 is monitored to suitably apply dressing to the inside grindstone 100. However, no sufficient effects are obtained. Further, the following drawback also occurs. That is, frequent dressing operations reduce the cutting efficiency per se, and the service life of the grindstone is also reduced.

SUMMARY OF THE INVENTION

The invention has been done in order to dissolve the drawbacks of the conventional technique, and it is therefore an object of the invention to provide an inside grindstone and a method of washing the same, in which wafers can be cut down with a slight machining allowance and efficiently in time, in which parallelism, surface roughness and so on of the wafers can be maintained at high quality, and in which the service life of the grindstone can also be prolonged.

For the above purpose, according to the invention, there is provided an inside grindstone comprising:

an annular substrate;

a cutting-edge layer formed at an inner periphery of the annular substrate;

a plurality of depressions or concave cut-outs arranged on both sides of the cutting-edge layer; and abrasive grains arranged on both sides of the cutting-edge layer, wherein parts of the abrasive grains on both sides of an outer periphery of the cutting-edge layer are smaller in projecting amount than parts of the abrasive grains on an inner periphery of the cutting-edge layer.

According to the invention, there is also provided a method of washing the inside grindstone described above, comprising the step of blowing off shavings accumulated in said concave cut-outs arranged on both sides of said cutting-edge layer, by abrasive liquid and jetting gas jetted toward said cutting-edge layer, thereby discharging said shavings.

With the arrangement of the invention, the cutting operation is done by the cutting-edge layer at the inner periphery of the annular substrate, at which the projecting amount of the abrasive grains is large, and the shavings generated by the cutting are moved to the concave cut-outs at both sides of the cutting-edge layer and are accumulated in the concave cut-outs. Accordingly, loading can be prevented from occurring at the inner periphery of the cutting-edge layer, while the work cut surface is maintained at sufficient parallelism and surface roughness by the cutting-edge layer at the outer periphery of the annular substance at which the projecting amount of the abrasive grains is small, and is finished smoothly. Thus, unreasonable cutting resistance due to the loading does not act upon the cutting-edge layer. In this manner, deformation of the cutting-edge layer and the annular substrate, and an increase in a layer of processing change in quality in the work can beforehand be prevented from occuring. Accordingly, it is possible to cut down the wafers efficiently with a slight machining allowance, which are superior in parallelism and surface roughness. Further, since frequent dressing can be dispensed with for modifying or correcting the deformation of the cutting-edge layer, the service life of the grindstone per se can be prolonged, and the substantial processing speed can be improved.

Furthermore, the shavings accumulated in the concave cut-outs are blown off and discharged by the abrasive liquid and the jetting gas which are jetted toward the cutting-edge layer, whereby the discharging effects of the shavings at the concave cut-outs and the cooling effects at cutting can further be improved.

The inside grindstone according to the invention is mounted to a vertical cutter or the like to perform cutting operation.

The work is cut by the cutting-edge layer formed at the inner periphery of the annular substrate, chiefly, at the inner periphery of the cutting-edge layer, so that the cutting proceeds. The shavings generated at the cutting are moved toward the cutting-edge layer, that is, are moved to and accumulated in the concave cut-outs provided on both sides of the cutting-edge layer, together with the abrasive liquid jetted immediately before the cutting-edge layer is cut into the work. Thus, it is possible to prevent the inner periphery of the cutting-edge layer from being loaded.

The shavings and the abrasive liquid, which are accumulated in the concave cut-outs provided on both sides of the cutting-edge layer, are blown off by the abrasive liquid and the jetting gas which are discharged immediately after the cutting-edge layer has gotten out of the work.

Furthermore, both sides of the outer periphery of the cutting-edge layer, in which the projecting amount of the abrasive grains is small, grind the work cut surface, so that the latter can be finished smoothly.

DETAILED DESCRIPTION OF THE PREFERRED EMBODIMENT

Figure 1:
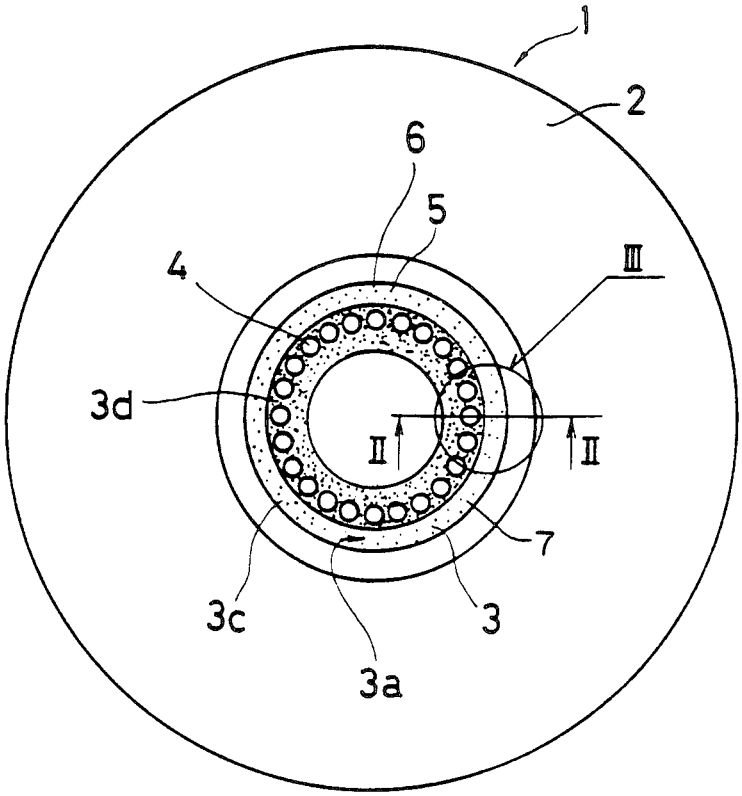
FIG. 1 is a top plan view of an inside grindstone according to an embodiment of the invention.

Referring to FIG. 1, there is shown an inside grindstone 1 which comprises an annular substrate 2. The annular substrate 2 has an inner periphery which is formed with a cutting-edge layer 3. The cutting-edge layer 3 has both sides 3*a* and 3*b* which have a plurality of concave cut-outs 4 arranged along a concentric circle of the annular substrate 2. The opposite sides 3*a* and 3*b* of the cutting-edge layer 3 in an outer periphery 3*c* thereof have abrasive grains 5 whose projecting amount is smaller than that of abrasive grains 5 in an inner periphery 3*d* of the cutting-edge layer 3.

The cutting-edge layer 3 is formed by a bond 6 consisting of an electrodeposition bond and the abrasive grains 5 consisting of diamond particles. Each of the opposite sides 3*a* and 3*b* of the cutting-edge layer 3 in the outer periphery 3*c* thereof is formed with a nickel plating layer 7 which forms a part of the cutting-edge layer 3, to restrict the projecting amount of the abrasive grains 5.

Figure 2:
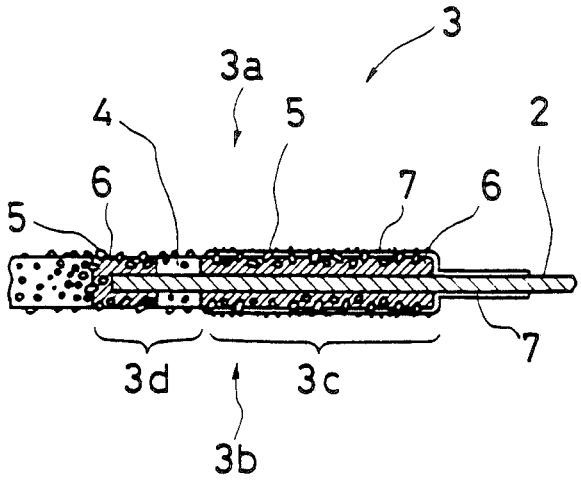
FIG. 2 is a cross-sectional view taken along the line II—II in FIG. 1.
Figure 3:
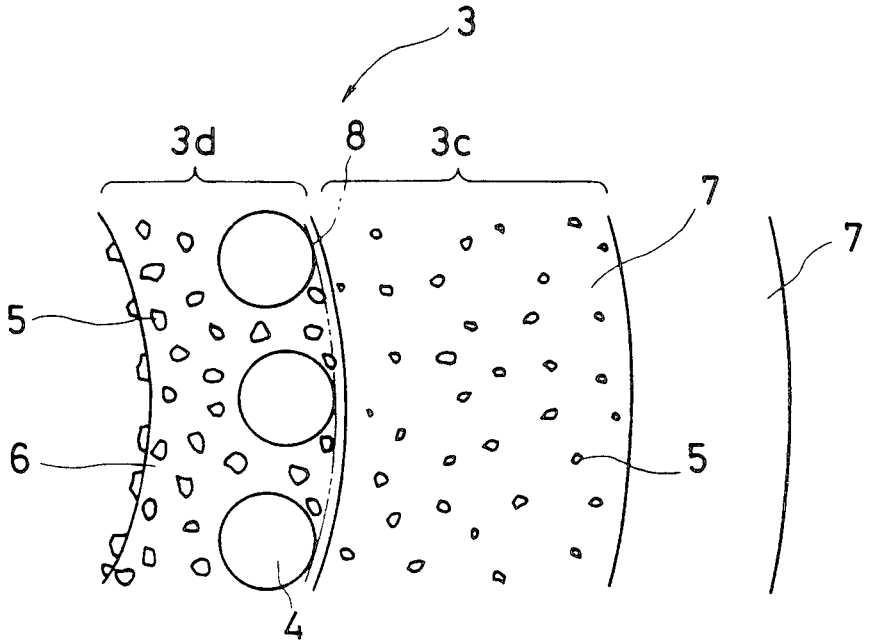
FIG. 3 is a fragmentary enlarged view of a portion encircled by III in FIG. 1.

Parts of the cutting-edge layer 3, at which the nickel plating layers 7 are formed, are not limited only to the opposite sides 3*a* and 3*b* of the outer periphery 3*c*. Each of the nickel plating layers 7 may have its inner peripheral line which is formed within a range on the outside of a concentric circle 8 on the annular substrate 3, indicated by the double dotted line in FIG. 3, with some gap left between the concentric circle 8 and the inner peripheral line of the nickel plating layers 7. The concentric circle 8 is a tangent of the plurality of concave cut-outs 4 at the opposite sides 3*a* and 3*b*. Further, an outer peripheral line of each of the nickel plating layers 7 is not specially limited. For instance, as shown in FIG. 2, the nickel plating layers 7 may extend from the outer periphery 3*c* of the cutting-edge layer 3 further outwardly along the concentric circle on the annular substrate 2.

Moreover, the arrangement may be such that particles finer than the abrasive grains 5 are mixed with the nickel plating layer 7, are electrodeposited in mixture with the abrasive grains 5, and are used as abrasive together with the abrasive grains 5 which project from the nickel plating layers 7.

Figures 4A, 4B, 4C, 4D:
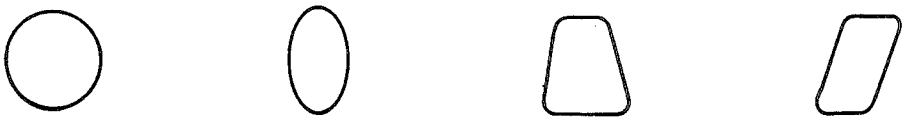
FIGS. 4(*a*) through 4(*d*) are views showing various examples of one of a plurality of concave cut-outs illustrated in FIGS. 1 through 3.
Figure 5:
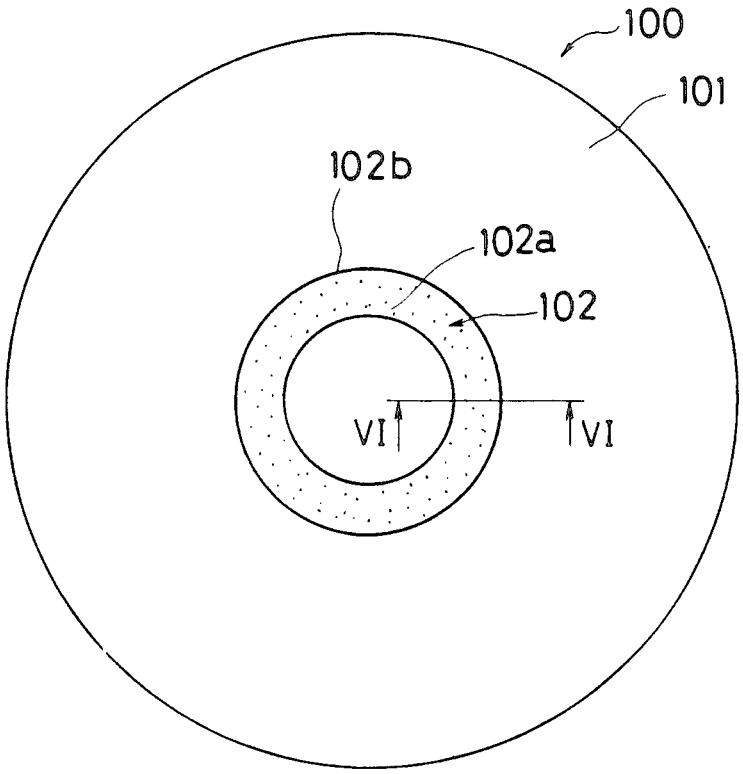
FIG. 5 PRIOR ART
FIG. 5 is a top plan view of the conventional inside grindstone.
Figure 6:
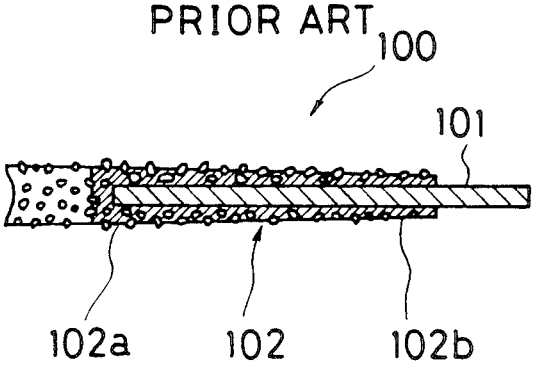
FIG. 6 PRIOR ART
FIG. 6 is a cross-sectional view taken along the line VI—VI in FIG. 5.

Furthermore, there is the following case. That is, in order to remove a layer of processing change in quality of several tens of micrometers on the work generated by cutting at the inner periphery 3*d* of the cutting-edge layer 3 to smooth the work, the outer periphery 3*c* including the nickel plating layers 7 and the abrasive grains 5 is made larger in thickness than the inner periphery 3*d* of the cutting-edge layer 3, whereby the grinding efficiency is further raised. Further, the concave cut-outs 4 may be arranged in a plurality or rows extending respectively along a plurality of concentric circles on the annular substrate 2, which are different in diameter from each other. In this case, if the concave cut-outs 4 arranged along the concentric circle having the minimum diameter are excluded, a part of the cutting-edge layer 3 extending about the concave cut-outs 4 may completely be covered by the nickel plating layers 7. Moreover, the configuration of the concave cut-outs 4 is not limited to a circle, but, as shown in FIGS. 4(*a*) through 4(*d*), the configuration of the concave cut-outs 4 may suitably be selected optionally from an ellipse, a trapezoid, a parallelogram, a square, a rectangle or the like, or from any combination thereof or the like. Furthermore, it is of course that the dimension or magnitude of the concave cut-outs 4, the number of rows along which the concave cut-outs 4 are arranged, the number of the concave cut-outs 4 in each row, or the like can optionally be selected. The concave cut-outs 4 may be arranged adjacent each other, or may continue to each other. Considering from the viewpoint of mechanical strength, however, it is desirable that the concave cut-outs 4, which are the same in configuration and magnitude as each other, are arranged on the front and rear sides of the cutting-edge layer 3, that is, on positions corresponding respectively to the opposite sides 3*a* and 3*b*.

In the inside grindstone 1 having the abovedescribed construction, the nickel plating layers 7 increase the mechanical strength of the inner periphery of the annular substrate 2. By tension force applied to the inside grindstone 1 when the same is mounted to the vertical cutter or the like, the strength increases which is opposed to the peripheral stress generated at the inner periphery of the annular substrate 2. Thus, the rigidity of the cutting-edge layer 3 increases so that it is possible to do stable cutting operation. In addition thereto, a part of the cutting-edge layer 3 between the concave cut-outs 4 arranged along the concentric circle of the annular substrate 2, particularly, a part of the bond 6 therebetween holds or retains the inner periphery 3*d* like a beam against an external force such as the cutting resistance or the like acting upon the inner periphery 3*d*. Accordingly, chatter occurring at the cutting operation and deformation of the annular substrate 2 are prevented so that an increase in the machining allowance can be restrained.

The cutting operation is done by the forward end of the cutting-edge layer 3 formed at the inner periphery of the annular substrate 2, that is, by the inner periphery 3*d* in which the projecting amount of the abrasive grains 5 is large. Shavings generated due to cutting are moved to and accumulated in the concave cut-outs 4 provided on the opposite sides 3*a* and 3*b* of the cutting-edge layer 3, together with the abrasive liquid blown against the cutting-edge layer 3, through a gap between the bond 6 and the work cutting surface in the inner periphery 3*d*, that is, through a gap formed on the basis of the dimension or magnitude of the projecting amount of the abrasive grains 5, during a period for which the part of the inner periphery 3*d* having done cutting is present within the work. Thus, it is possible to prevent loading from occurring at the inner periphery 3*d* which effects the cutting operation. Further, since the outer periphery 3*c* having the nickel plating layers 7 is smaller in gap between the work cutting surface and the outer periphery 3*c* than the inner periphery 3*d*, shavings can be prevented from invading a location between the outer periphery 3*c* and the work cutting surface to injure or damage the same.

On the other hand, since the projecting amount of the abrasive grains 5 at the opposite sides 3*a* and 3*b* in the outer periphery 3*c* of the cutting-edge layer 3 is smaller than that of the abrasive grains 5 in the inner periphery 3*d*, excessive cutting is prevented with respect to the work cut surface so that the work cut surface is maintained at sufficient parallelism and surface roughness and is finished. In addition, an external force due to unreasonable cutting resistance does not act upon the cutting-edge layer 3, so that it is possible to beforehand prevent deformation of the cutting-edge layer 3 and the annular substrate 2 and an increase in the layer of processing change in quality in the work. Accordingly, unlike the conventional grindstone, the abrasive grains 5 are prevented from falling off due to unreasonable cutting resistance, and wear is prevented from occurring on the bond 6. Further, it can be dispensed with to frequently dress the grindstone 1 in order to rectify or correct deformation of the cutting-edge layer 3. Thus, the service life of the grindstone 1 is prolonged.

Furthermore, the following washing method is applied to the inside grindstone 1 according to the embodiment.

Specifically, in the cutting operation due to the inside grindstone 1, the abrasive liquid is blown against the cutting-edge layer 3, and high-speed jetting gas is jetted against the cutting-edge layer 3. By doing so, shavings accumulated in the concave cut-outs 4 are blown off together with the abrasive liquid and are discharged. In this case, if the gas is blown against both side surfaces of the cutting-edge layer 3 having provided therein the concave cut-outs 4, in the inclined or oblique direction, it is further ensured that the shavings are discharged. As described previously, the shavings generated during cutting are moved to and accumulated in the concave cut-outs 4 through the gap between the bond 6 and the work cut surface during a period for which the part of the inner periphery 3*d* having done cutting is present within the work. Immediately after the part of the inner periphery 3*d* is moved away from the work, the jetted abrasive liquid and high-speed jetting gas are blown against the cutting-edge layer 3 simultaneously from substantially the same position, whereby the jetted abrasive liquid and high-speed jetting gas are discharged out of the concave cut-outs 4. Thus, the concave cut-outs 4 in the part of the inner periphery 3*d* are again filled with the abrasive liquid in the vicinity of the contact point between the work and the concave cut-outs 4, to cut the work.

According to the washing method, sufficient abrasive liquid is supplied to a location between the inner periphery 3*d* and the work cut surface to increase the cooling effects. Moreover, the discharging effects of the shavings from the concave cut-outs 4 are further promoted or expedited. Thus, the opening area of each of the concave cut-outs 4 can be made further small in the construction of the inside grindstone 1, so that the plurality of concave cut-outs 4 can be arranged at a location nearer to the inner periphery of the annular substrate 2. Accompanied with this, it is possible to form the nickel plating layers 7 to a location nearer to the inner periphery of the annular substrate 2. Thus, it is possible to further increase the rigidity of the cutting-edge layer 3.

What is claimed is:

1. An inside grindstone comprising:

an annular substrate;

a cutting-edge layer formed on at least one side of said annular substrate at an inner periphery thereof;

a plurality of depressions arranged in said cutting-edge layer;

abrasive grains of a selected size, and means for bonding said abrasive grains to said substrate to form said cutting-edge layer, and further including means, disposed in an outer periphery of said cutting-edge layer, for limiting the extent to which the abrasive grains, coextensive with said limiting means, are exposed for cutting, whereby said grains coextensive with said limiting means are smaller in projecting amount to define a smoother abrasive surface than the surface defined by others of said abrasive grains on an inner periphery of said cutting-edge layer.

2. The inside grindstone according to claim 1, wherein said depressions are arranged along at least one concentric circle on said annular substrate.

3. The inside grindstone according to claim 1, wherein said cutting-edge layer is formed on both sides of said substrate and said limiting means includes a plating layer disposed along the outer periphery of each said cutting-edge layer.

4. The inside grindstone according to claim 3, wherein each of said plating layers is made of nickel and has its inner peripheral line located outwardly from an imaginary concentric circle on said annular substrate which circle is defined by tangents respectively intersecting said plurality of depressions with a gap formed between said concentric circle and said inner peripheral line of each nickel plating layer.

5. The inside grindstone according to claim 3, wherein each of said plating layers extends outwardly from the outer periphery of said cutting-edge layer.

6. The inside grindstone according to claim 3, wherein each of said plating layers has mixed therewith particles finer than said abrasive grains.

7. The inside grindstone according to claim 1, wherein said outer periphery of said cutting-edge layer has a thickness larger than that of said inner periphery of said cutting-edge layer.

8. The inside grindstone according to claim 2, wherein said depressions are arranged, in a plurality of rows, on a plurality of concentric circles on said annular substrate, which circles are of different diameter from each other.

9. The inside grindstone according to claim 2, wherein said depressions are arranged respectively at corresponding positions to each other on opposite sides of said substrate, said depressions being of the same configuration and size.

* * * * *